US007493876B2

(12) United States Patent
Strempek et al.

(10) Patent No.: US 7,493,876 B2
(45) Date of Patent: Feb. 24, 2009

(54) PASSIVE MIXING DEVICE FOR STAGED COMBUSTION OF GASEOUS BOILER FUELS

(76) Inventors: Joseph Robert Strempek, 88 Morningside Dr., - Apt. 2, Akron, OH (US) 44303; Ronald C. Lenzer, 207 Cordelia St., SW., North Canton, OH (US) 44720

( * ) Notice: Subject to any disclaimer, the term of this patent is extended or adjusted under 35 U.S.C. 154(b) by 0 days.

(21) Appl. No.: 11/775,919

(22) Filed: Jul. 11, 2007

(65) Prior Publication Data

US 2009/0017402 A1 Jan. 15, 2009

(51) Int. Cl.
*F23C 10/18* (2006.01)

(52) U.S. Cl. ..... 122/4 D; 431/7

(58) Field of Classification Search ..... 122/4 D, 122/512, 235.12, 235.21, 235.23, 216, 420, 122/459, 467; 431/7, 326, 329
See application file for complete search history.

(56) References Cited

U.S. PATENT DOCUMENTS 4,354,821 A * 10/1982 Kesselring et al. ..... 431/7
4,953,512 A * 9/1990 Italiano ..... 122/4 D
5,020,479 A * 6/1991 Suesada et al. ..... 122/235.11
5,080,577 A * 1/1992 Bell et al. ..... 431/7
5,141,432 A * 8/1992 Bell et al. ..... 431/7
5,160,254 A * 11/1992 Bell et al. ..... 431/7
5,476,375 A * 12/1995 Khinkis et al. ..... 431/7
5,522,723 A * 6/1996 Durst et al. ..... 431/328
5,544,624 A * 8/1996 Xiong ..... 122/4 D
5,635,139 A * 6/1997 Holst et al. ..... 431/7
5,711,661 A * 1/1998 Kushch et al. ..... 431/329
5,819,673 A * 10/1998 Heywood et al. ..... 110/346
6,159,001 A * 12/2000 Kushch et al. ..... 431/7
6,213,757 B1 * 4/2001 Kushch et al. ..... 431/7
6,257,868 B1 * 7/2001 Durst et al. ..... 431/7
7,041,410 B2 * 5/2006 Oosterkamp ..... 429/32

* cited by examiner

*Primary Examiner*—Gregory A Wilson
(74) *Attorney, Agent, or Firm*—Michael J. Seymour; Eric Marich

(57) ABSTRACT

A steam generating boiler having a matrix means for reducing combustion volume. Matrix means is placed in the combustion furnace of a steam generating boiler, preferably downstream of fuel and oxidant stream. Matrix means produces a shorter combustion envelope than that of a conventional boiler, allowing for reduced volume steam generating boilers.

10 Claims, 8 Drawing Sheets

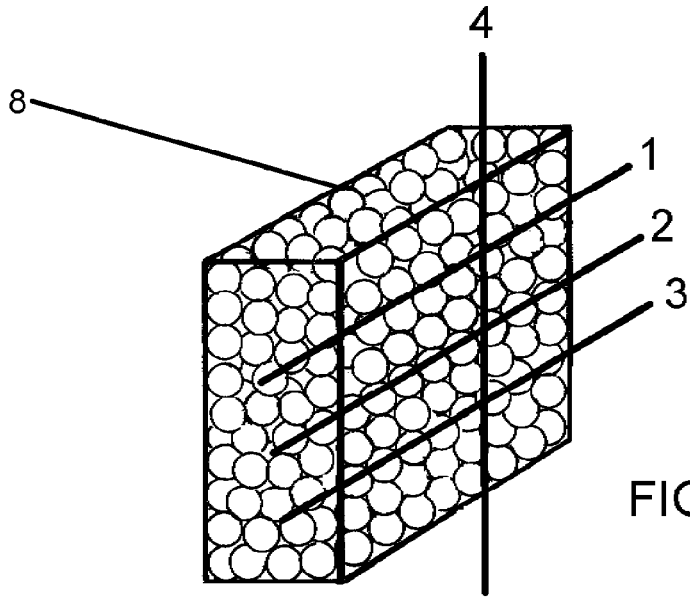
FIG. 9
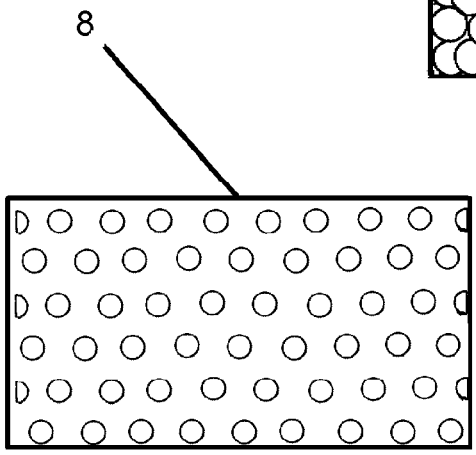
PLANE 1
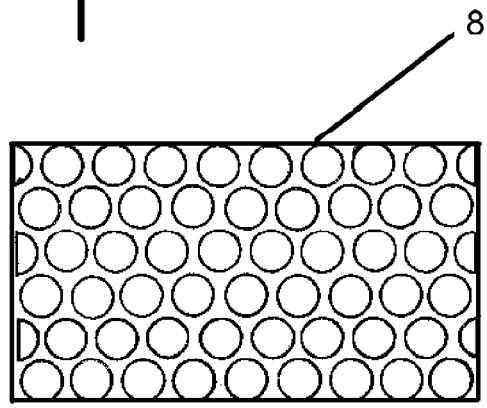
PLANE 2
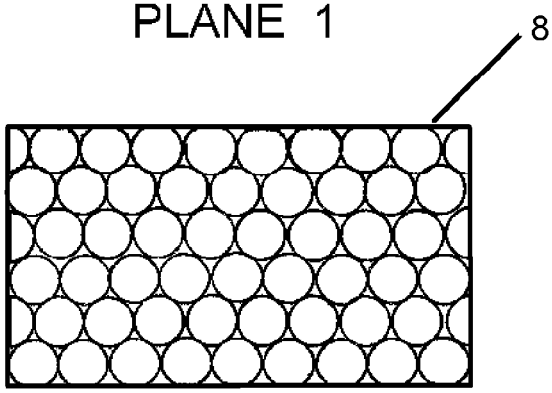
PLANE 3
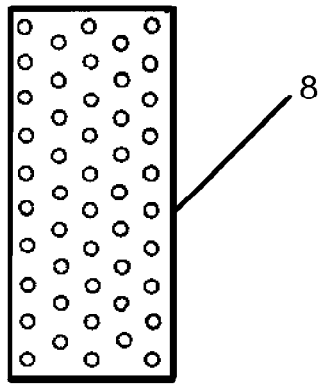
PLANE 4

PASSIVE MIXING DEVICE FOR STAGED COMBUSTION OF GASEOUS BOILER FUELS

FIELD OF THE INVENTION

The present invention relates generally to fossil fuel combustion, and in particular, to a new and useful method and apparatus for gaseous fuel combustion in a steam generating boiler.

BACKGROUND OF THE INVENTION

Fossil fuel burners convert chemical energy stored in fossil fuels to thermal heating by combusting the fossil fuel in the presence of an oxidant. In power generating applications, thermal heat may be transferred to water in order to produce steam for driving electricity producing turbines. In non power generating applications, thermal heat can be transferred to any number of conceivable objects or processes.

Conventional steam generating boilers generally comprise of one or more burners, one or more fuel injection points, one or more oxidant injection points, and a means for propelling the injected fuel and oxidant into a combustion furnace. Upon ignition of the oxidant/fuel mixture (FIG. 1) a combustion envelope 4 is formed comprising a flame 3 and an oxidant/fuel mixing zone 2 between the flame 3 and the burner 1.

FIGS. 2 and 3 are schematic representations of conventional steam generating boilers utilizing a single and multiple burner(s) respectively. The interior walls comprise a plurality of steam generating tubes 6 fluidly connected to a boiler bank (not shown). Thermal energy produced within the combustion envelope 4 radiantly heats the tubes 6 which in turn conduct thermal energy to the water in the tubes 6 for the purpose of generating steam.

In many steam generating boilers, the length and width of the combustion envelope 4 play an integral role in the design of the combustion furnace 5. In FM boilers, for example, the combustion furnace 5 is preferably designed sufficiently large enough to avoid excessive contact of the combustion envelope 4 with the furnace walls 10. Also known as flame impingement, seen in FIG. 3, excessive flame 3 contact with a furnace wall 10 may result in incomplete combustion, leading to higher emissions of CO and other combustion byproducts, or premature degradation, leading to costly repairs and boiler downtime. Accordingly, combustion furnaces 5 are generally designed to accommodate a given burner combustion envelope 4 while minimizing the possibility of flame impingement.

Conventional burners generally utilize flow control mechanisms to control the axial and radial expansion of the combustion envelope 4. Radial expansion of the combustion envelope 4 is generally a function of swirl and the natural expansion of the fuel, oxidant, and flame. Some conventional burner designs utilize flow control mechanisms to restrict the natural radial expansion of the combustion envelope 4, resulting in a longer narrower flame. Shearing forces created by flow control mechanisms may also be used to influence the extent of oxidant/fuel mixing prior to combustion, thereby having an effect on emissions such as CO and NOx.

The availability of oxidant and fuel and their ability to mix prior to combustion influences the length of a combustion envelope 4 within a combustion furnace 5. Longer flames generally result from an insufficient supply of oxidant or inadequate mixing of the oxidant and fuel within the combustion envelope 4. Shorter flames generally result from a sufficient supply of oxidant and adequate mixing of the oxidant and fuel within the combustion envelope 4. Flame length may also be influenced by the velocity at which fuel and/or oxidant streams enter the combustion envelope 4. Excessive velocities or momentary interruptions of fuel and/or oxidant streams may cause the burner flame 3 to lose ignition. Such loss of ignition is especially undesirable, as it may result in an accumulation of combustibles susceptible to violent explosion upon reignition.

The U.S Department of Energy has articulated that a long felt need exists to reduce the size and weight of steam generator boilers such as industrial boilers. Conventional steam generating boilers are built to accommodate the size of the combustion envelope 4 produced. Accordingly, a long felt need exists to develop a combustion envelope 4 capable of producing sufficient thermal energy for steam production in a significantly smaller volume, thereby allowing the production of smaller, lighter, and more compact steam generating boiler designs.

SUMMARY OF THE INVENTION

The present invention solves the aforementioned problems and provides a steam generating boiler capable of firing liquid fuels, gaseous fuels, or any combination thereof.

An objective of the present invention is to provide a compact steam generating boiler.

Another objective of the present invention is to provide a steam generating boiler with a radially wider and axially shorter combustion envelope than that of conventional steam generating boilers.

Another objective of the present invention is to provide a low NOx and low CO steam generating boiler.

Another objective of the present invention is to provide a steam generating boiler capable of passively maintaining a constant ignition source.

Yet another objective of the present invention is to provide a means for designing a steam generating boiler of reduced size and weight as compared to that of a conventional steam generating boiler.

The present invention discloses a steam generating boiler. A steam generating boiler according to the present invention comprises a combustion furnace, an oxidant inlet, a fuel inlet, a matrix means, and steam tubes.

The various features of novelty which characterize the present invention are pointed out with particularity in the claims annexed to and forming a part of this disclosure. For a better understanding of the invention, its operating advantages and specific objects attained by its uses, reference is made to the accompanying drawings and descriptive matter in which the preferred embodiments of the invention are illustrated.

BRIEF DESCRIPTION OF THE DRAWINGS

In the accompanying drawings, forming a part of this specification, and in which reference numerals shown in the drawings designate like or corresponding parts throughout the same:

FIG. 9 is a preferred embodiment of a matrix means according to the present invention, wherein matrix cross sections are illustrated.

DESCRIPTION OF THE PREFERRED EMBODIMENTS

The present invention utilizes a combination of features to improve upon the design of conventional oil and gas fired steam generating boilers. Conventional oil and gas fired steam generating boilers include, but are not limited to: FM, High Capacity FM, PFM, PFI, PFT, SPB, and RB; all of which are described in Chapter 27 of *Steam/its Generation and Use,* 41th Edition, Kitto and Stultz, Eds., ©2005 The Babcock & Wilcox Company, the text of which is hereby incorporated by reference as though fully set forth herein.

For the purposes of explaining the present invention, schematic views of FM boiler are used herein. However, as one of ordinary skill in the art can appreciate, the intent of utilizing FM boiler schematics is merely for reason of example and not intended to limit the present invention to that of FM boiler embodiments.

Figure 1:
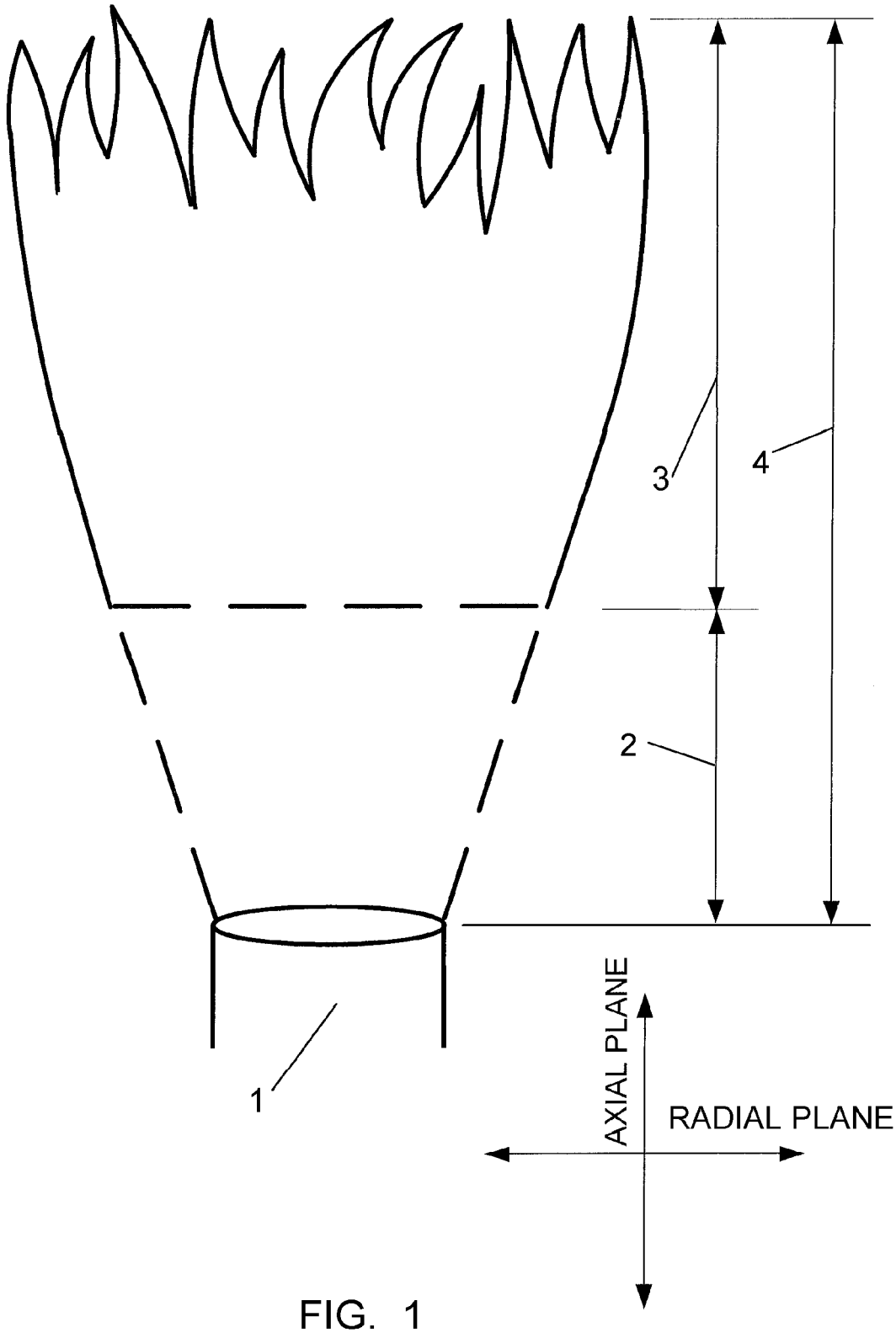
FIG. 1 is a schematic representation of a combustion envelope.
Figure 2:
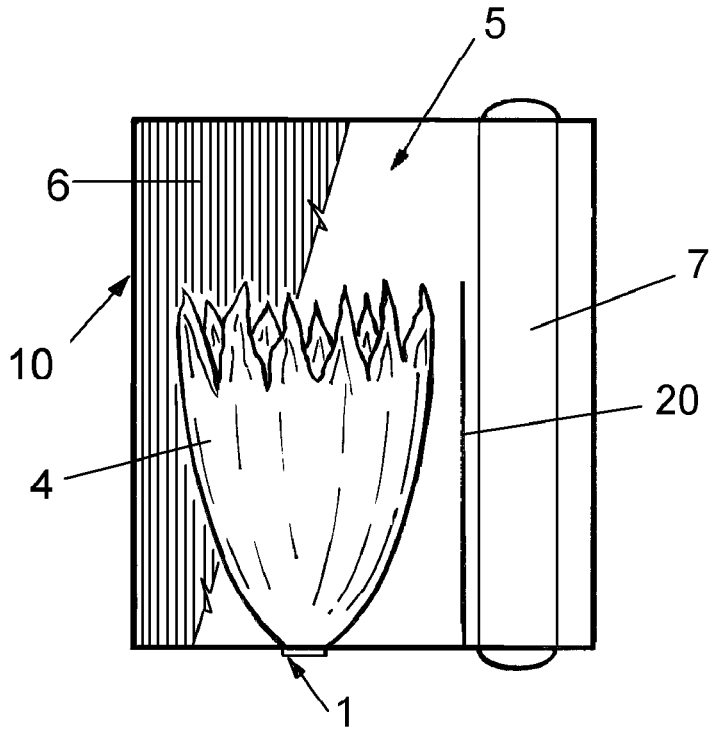
FIG. 2 is a schematic representation of a conventional industrial boiler utilizing a single burner.
Figure 3:
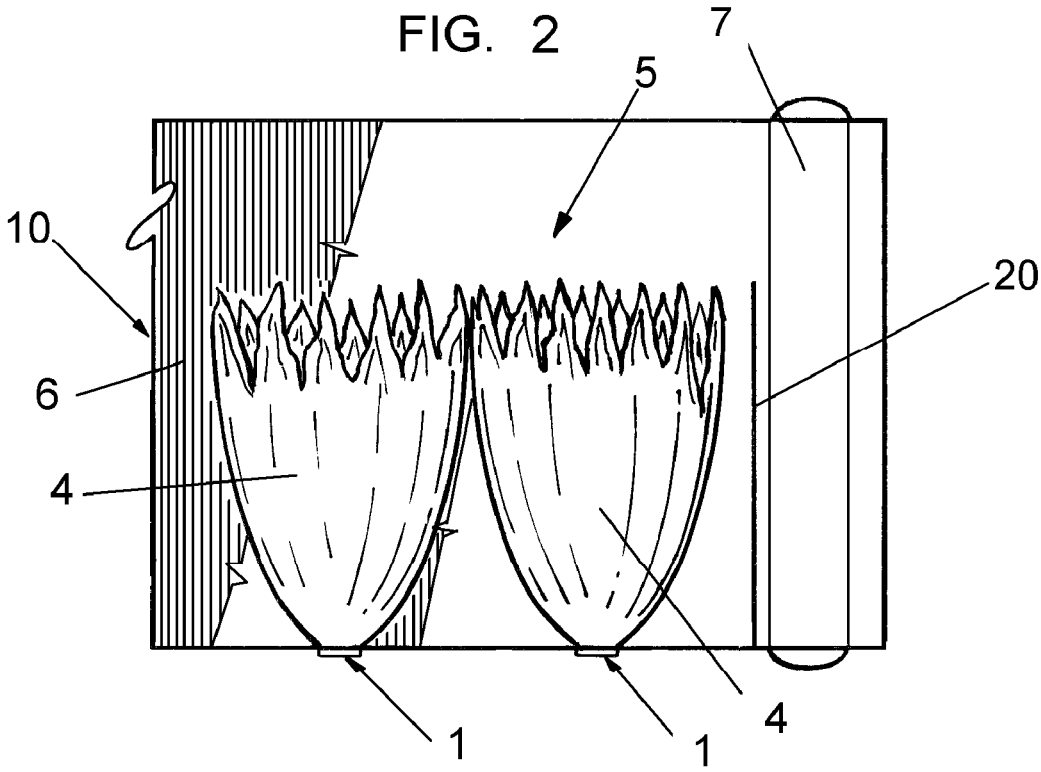
FIG. 3 is a schematic representation of a conventional industrial boiler utilizing more than one burner.
Figure 4:
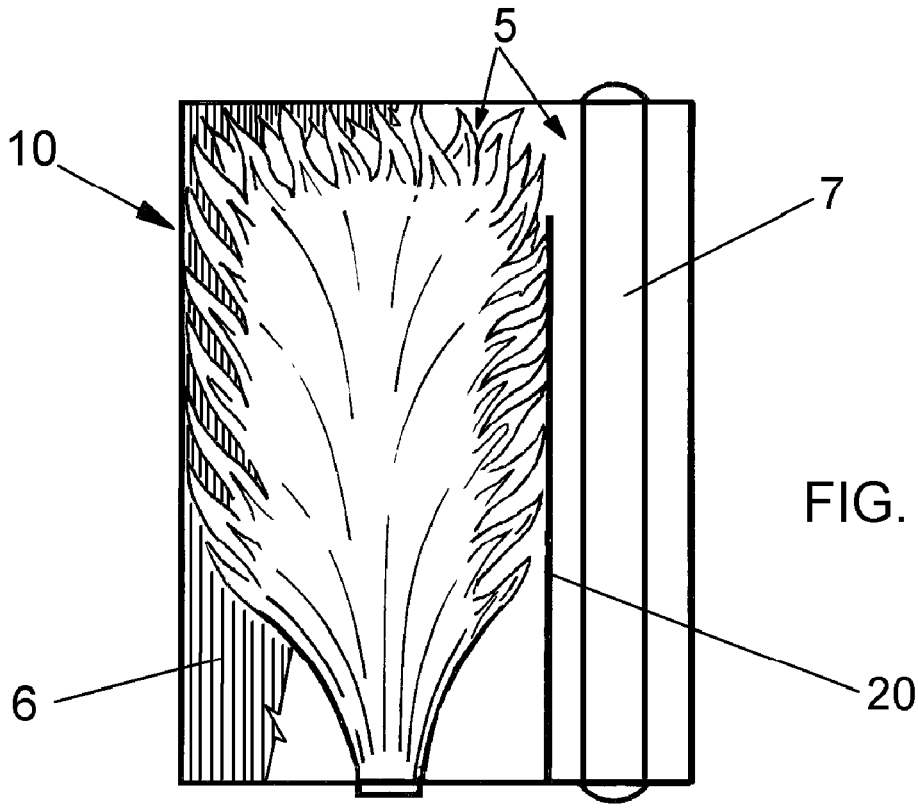
FIG. 4 is a schematic representation of an undesirable combustion envelope wherein excessive flame contact occurs along the length and width of the combustion furnace.

Referring to FIGS. 2 and 3, schematic representations of prior art FM boilers are shown. Within the FM boiler a baffle wall 20 separates a combustion furnace 5 from a boiler bank (not shown). Combustion envelope 4 is located inside the combustion furnace 5. Fuel and oxidant are delivered to burner 1, producing a combustion envelope 4 upon ignition.

The interior walls 10 of the combustion furnace comprise a series of tubes 6 fluidly connected to a steam drum 7, producing steam used for process of electrical generation purposes. The conically diffusing shape of the combustion envelope 4 results in significant unused combustion furnace volume along side the combustion envelope 4 as it expands.

Figure 5:
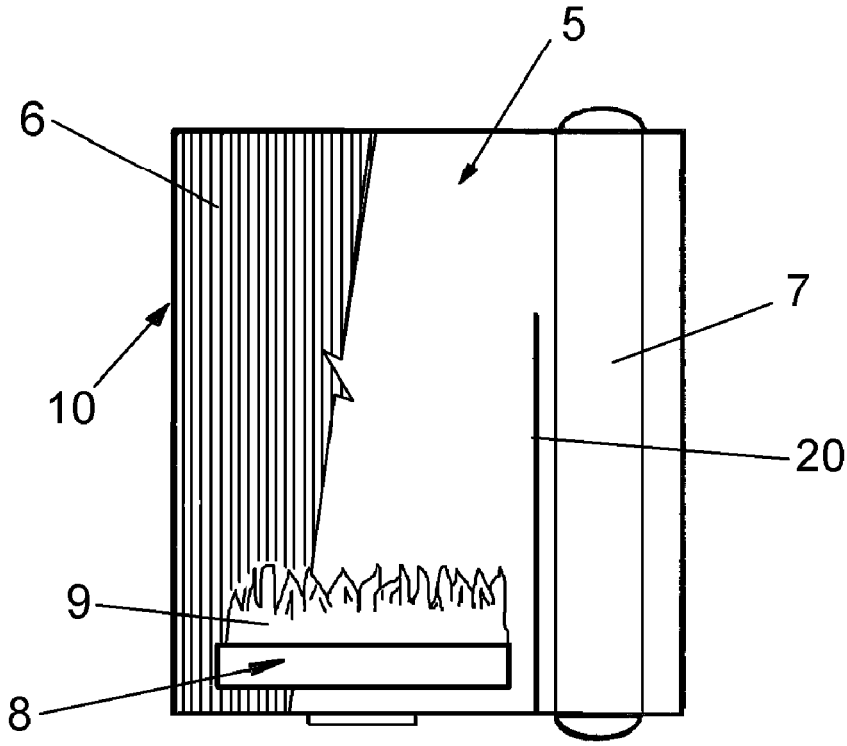
FIG. 5 is an embodiment of the present invention, wherein a matrix means is retrofitted into the combustion furnace of an existing steam generating boiler.

An object of the present invention is to reduce unused combustion furnace volume. The present invention provides a matrix 8, placed either within or prior to the flame of the combustion envelope. Referring to FIG. 5, a retrofit embodiment of the present invention is shown. Matrix 8 is placed with combustion furnace 5 downstream of the burner 1. Fuel and oxidant enter matrix 8, wherein the cross sectional design of matrix 8 provides a means for passively mixing gaseous streams and radially dispersing the resulting combustion envelope 9.

Figure 6:
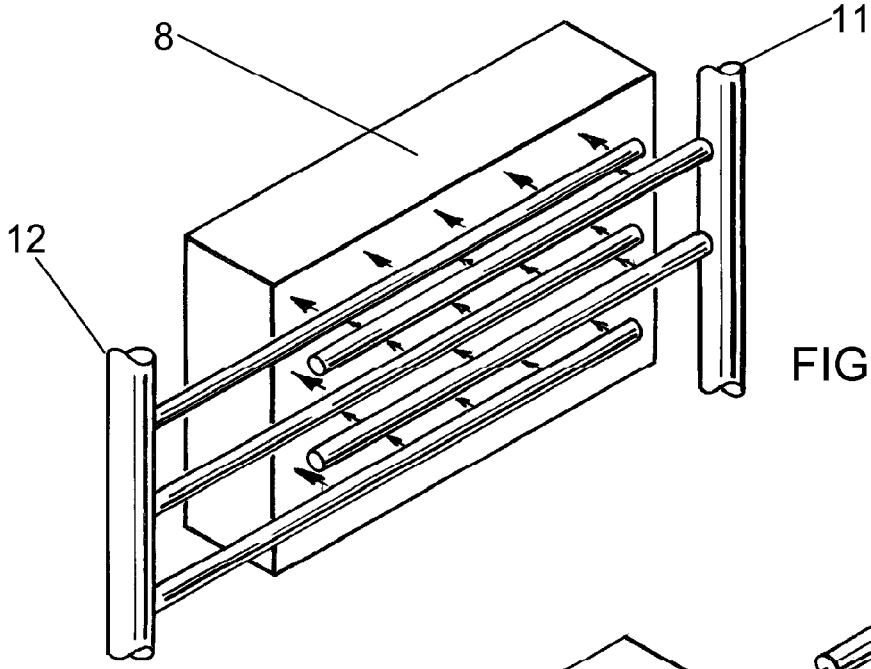
FIG. 6 is an illustration of an embodiment of the present invention wherein a fuel and an oxidant are introduced upstream of the a matrix means.
Figure 7:
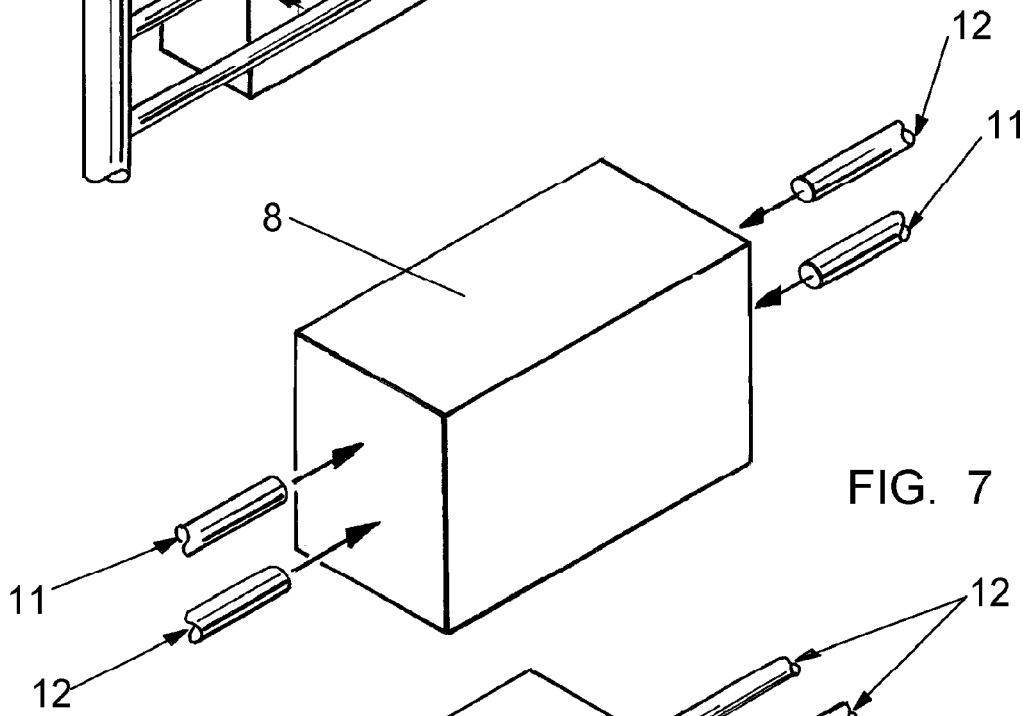
FIG. 7 is an illustration of an embodiment of the present invention wherein a fuel and an oxidant are introduced in the sides of a matrix means.
Figure 8:
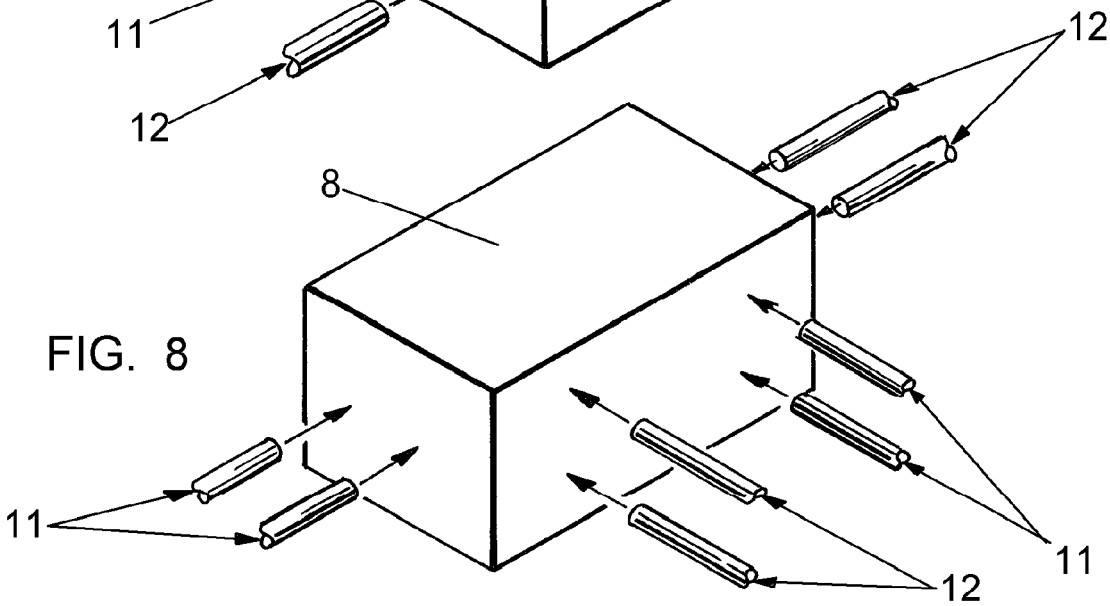
FIG. 8 is an illustration of an embodiment of the present invention wherein a fuel and an oxidant are introduced in both the front and the side(s) of a matrix means.

Provided to the matrix 8 is at least one gaseous fuel stream and at least one gaseous oxidant stream, or combinations thereof. The gaseous streams may enter the matrix 8 from any side. FIG. 6 illustrates a preferred embodiment where the fuel stream 12 and oxidant stream 11 are introduced upstream of the matrix 8. Alternatively, as shown in FIG. 7 and FIG. 8, the gaseous streams 11, 12 may enter the matrix 8 from the side(s) only or a combination of the front and side(s) of the matrix 8.

Referring to FIG. 9, a preferred embodiment of a matrix 8 according to the present invention is illustrated. In this embodiment, the combustion apparatus is a matrix 8 comprising at least one layer of spheres. The spheres may be arranged in either a random or ordered manner within the matrix 8. The spheres may be hollow, solid, or porous in nature, or any combination thereof. The spheres may vary in size or be of a substantially similar size. The spheres preferably comprise a high temperature metal or ceramic capable of withstanding the extreme temperatures to which the matrix 8 may be exposed during the combustion of fossil fuels, however, spheres comprising any known material may be used.

Referring to FIG. 9, four cross sectional matrix planes are identified to schematically represent variations in open area for gaseous flow across the matrix 8. Plane 1 is approximately 46 percent open, plane two is approximately 31 percent open, plane 3 is about 9 percent open, and plane 4 is about 58 percent open.

An object of the present invention is improved mixing of the gaseous streams. Improved mixing is achieved in the presence of a matrix 8 comprising at least two cross sectional planes having different percentages of open area, such that a first cross sectional plane possesses a greater percentage of open area for gaseous flow than a second cross sectional plane. Plane 1 and plane 2 of FIG. 9 are two cross sectional planes having different percentages of open area for gaseous flow. As the gaseous streams pass between the two planes, a pressure differential is encountered forcing the gas streams to compress or expand; thereby creating shearing forces and mixing the gaseous streams. The superior mixing provided by the matrix 8, minimizes CO and excess air need to complete combustion.

Another object of the present invention is to radially disperse the combustion envelope. Radial dispersion is achieved in the presence of matrix 8 comprising at least two cross sectional planes having different percentages of open area, wherein the two planes are taken from different axes, and a first cross sectional plane possesses a greater percentage of open area for gaseous flow than a second cross sectional plane. Plane 3 and plane 4 of FIG. 9 are cross sectional planes of different axes having different percentages of open area for gaseous flow. As the gaseous streams approach plane 3, resistance is encountered due to the relatively low open area for gaseous flow across plane 3, forcing a portion of gas to change its vector towards a plane of lower flow resistance, such as plane 4; thereby axially suppressing and radially dispersing the combustion envelope.

The present invention provides a combustion apparatus that allows for improved steam generating boiler designs while retaining similar heat output. Referring back to FIGS. 5, a schematic representation of the present invention retrofitted into a convention FM boiler is shown. The present invention radially expands the combustion envelope 4, resulting in a shorter combustion envelope 9, wherein unused combustion volume is shifted downstream of the combustion envelope 9. In retrofit applications, additional steam generating equipment can be placed in the unused combustion volume, thereby maximizing energy generation potential.

A benefit of reducing the depth of a combustion furnace is the ability to develop new compact boiler designs without sacrificing heat output. Combustion furnaces 5 in steam generating boilers are generally designed to accommodate a given combustion envelope 4 while minimizing risk of flame impingement. Shortening the combustion envelope 4 allows for significant furnace depth reduction at any given heat output. Use of the present invention reduces boiler size, thus weight, as shorter boilers utilize considerably less raw materials to make boiler walls and tubes 6.

A matrix 8 according to the present invention may be placed anywhere within the combustion envelope 4. Preferably the matrix 8 is placed within the mixing zone 2 and will be of a depth sufficient to allow combustion to begin within the matrix 8 and combustion flames 3 to exit the matrix 8 downstream of where fuel and oxidant are introduced. In this embodiment, flame width is maximized as ignition of the combustible stream creates expansive forces, enabling further radial expansion within the matrix 8.

An additional benefit of the present invention is passively maintaining a constant ignition source. In this embodiment, the matrix 8 is comprised of a material capable of retaining thermal heat. When a flame would otherwise lose ignition due to excessive velocities or fluctuations in fuel and/or oxidant streams, the thermal heat retained within the matrix elements provides a thermal reservoir sufficient to maintain ignition; thereby avoiding undesirable situations associated with delayed re-ignition.

Figure 10:
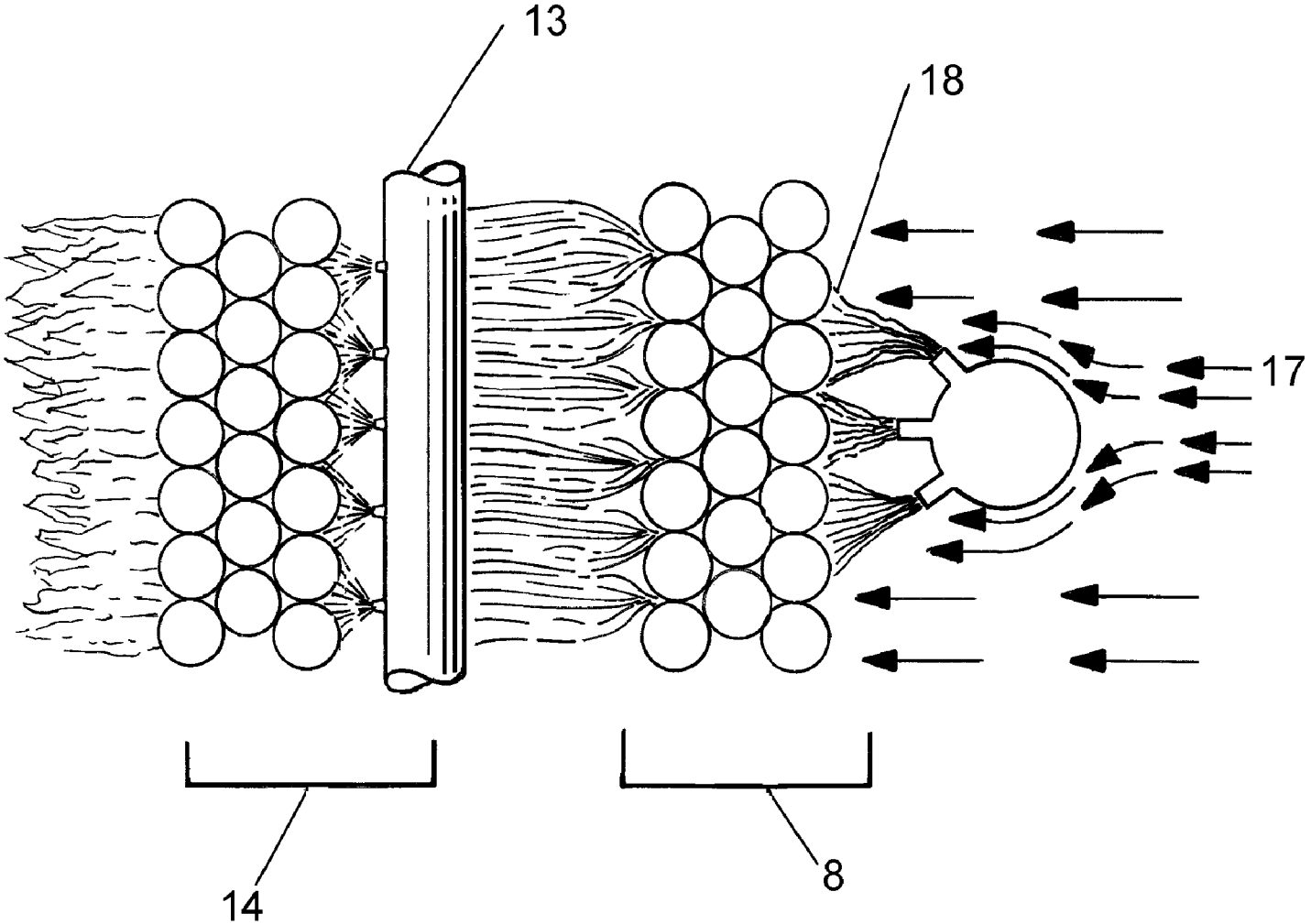
FIG. 10 is a graphic representation of an embodiment of the present invention where two matrix means are used to facilitate staged combustion.

In another embodiment of the present invention, a steam generating boiler may utilize more than one matrix 8. FIG. 10 is a graphic representation of an embodiment of the present invention where two matrixes are used to facilitate staged combustion. In this embodiment, a second matrix 14 is located downstream of a first matrix 8. The first matrix 8 is provided with a fuel stream 18 and substoichiometric oxidant 17 to inhibit the production of undesirable combustion byproducts such as NOx. A second oxidant stream 13, providing sufficient oxygen to burn remaining fuel, is provided downstream of the first matrix 8 and upstream of the second matrix 14.

Figure 11:
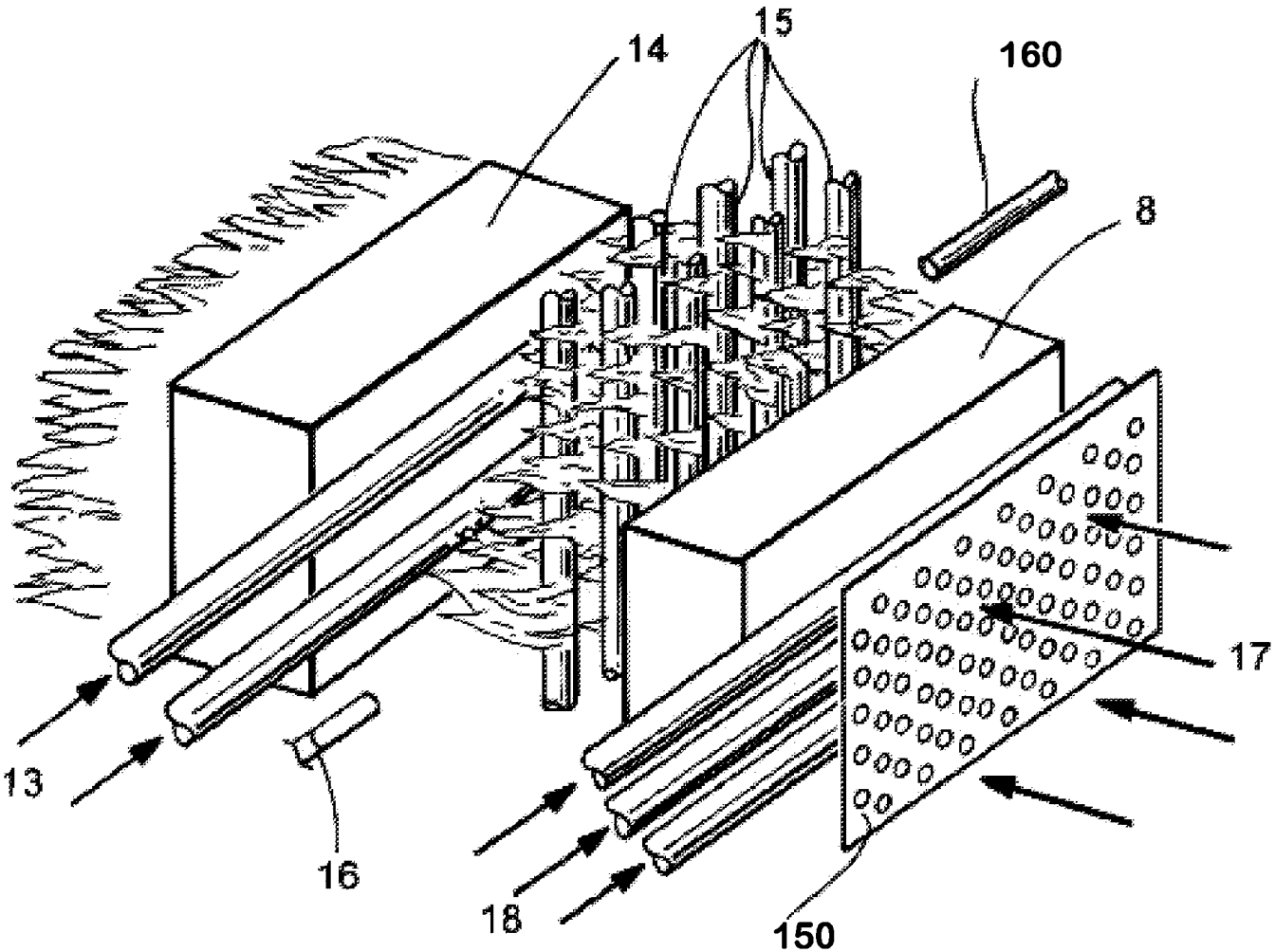
FIG. 11 is a graphic representation of a staged combustion embodiment of the present invention wherein interstaged cooling is used in a two matrix means staged combustion boiler.

FIG. 11 illustrates an alternative two matrix staged combustion embodiment according to the present invention. In this embodiment, cooling tubes 15 are placed between the two matrixes 8, 14 for the purpose of controlling flame temperature and the formation of thermal NOx. A perforated plate 150 may also be placed upstream of the first matrix 8, serving the function of acting as a flame arrestor and/or pre distributing the substoichiometric oxidant 17.

In another embodiment of the present invention, a sensor 16 may be placed within the combustion furnace for observing the combustion process within the combustion furnace 5.

In another embodiment of the present invention, a igniter 160 may be placed within the combustion furnace for preheating the matrix 8 or igniting a fuel and oxidant.

Figure 12:
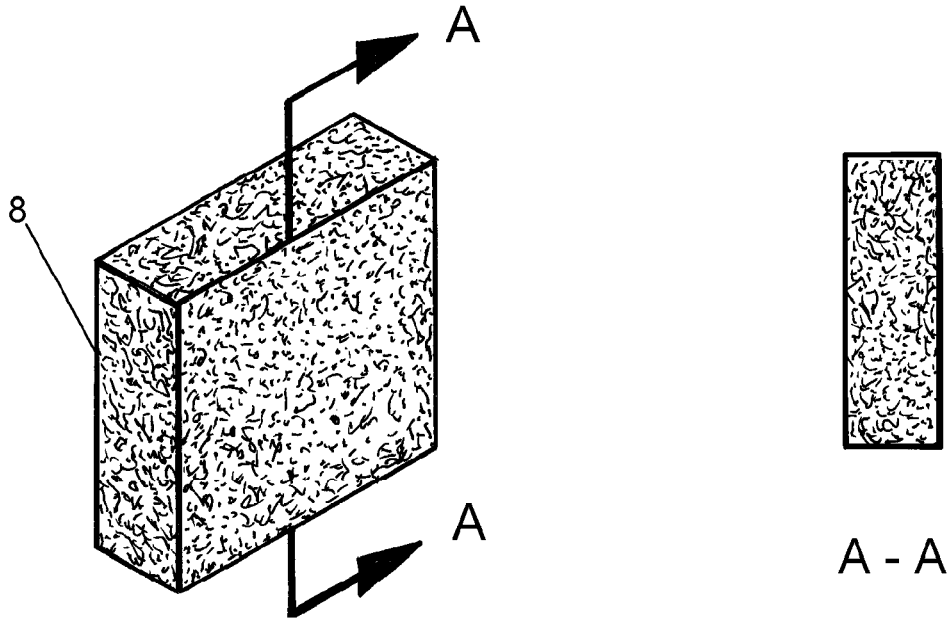
FIG. 12 is a graphical illustration of an alternative embodiment of a matrix means according to the present invention.

FIG. 12 provides a graphical representation of another embodiment of the present invention. In this embodiment, the matrix 8 comprises a random or ordered block of fibers or interlaced particles. Between the fibers and particles of this embodiment are series of internal passage having cross sections of varying open area for gaseous flow providing a means for gaseous fuel and oxidant streams to passively mix and radially disperse within the matrix 8. Section A-A provides a cross section view of the present embodiment.

Figure 13:
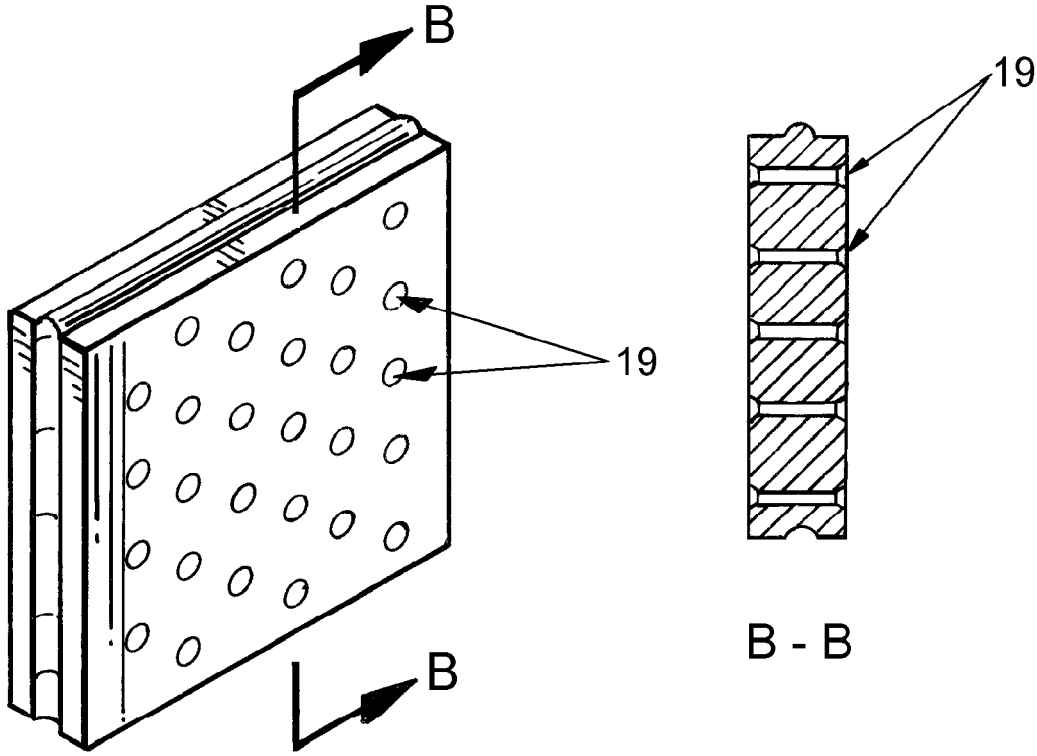
FIG. 13 is a graphical illustration of another alternative embodiment of a matrix means according to the present invention.

FIG. 13 provides a graphical representation of another embodiment of the present invention. In this embodiment the matrix 8 comprises fired or fitted tiles with venturi holes 19. An expanded view of a Section B-B of this embodiment is shown where the cross sectional dimensions of the venturi holes 19 are shown varying along the depth of the matrix 8.

In another embodiment of the present invention, oxidant and/fuel may be fed to the matrix 8 in multiple streams.

In another embodiment of the present invention, the matrix 8 can comprise of non-spherical elements or a combination of spherical and non-spherical elements arranged in either an ordered or non-ordered fashion.

In yet another embodiment of the present invention, the spheres or alternatively shaped elements may be coated with any number of chemical substrates known to one of ordinary skill in the art for the purpose of altering the chemistry of the fuel, enhancing combustion, and reducing pollutant emissions.

In yet another embodiment of the present invention, the matrix 8 itself can be rectangular, circular, or of any other geometric design. Generally, the matrix 8 elements of the present invention are held captive by a suitable apparatus for preventing movement between the spheres. Examples of suitable apparatus are, but are not limited to, wire frames and/or chemically or mechanically bonding the matrix 8 elements to one another.

In yet another embodiment of the present invention, multiple matrixes may be arranged in parallel within a boiler. In such an embodiment, multiple fuels may be combusted simultaneously, thereby providing combustion fuel flexibility to boiler designs.

In yet another embodiment of the present invention, forced air or recirculation fans may be utilized to create a pressure differential across the matrix 8 to either promote or restrict gaseous flow there through.

We claim:

1. A steam generating boiler, comprising: and a combustion furnace having an inlet end, an outlet end, and further defined by a baffle wall and a plurality of furnace walls, wherein each of the furnace walls comprises a plurality of steam tubes aligned with the vertical length of the furnace wall and in fluid connection with a steam drum located on the opposite side of the baffle wall and downstream of the outlet end of the combustion furnace, a oxidant inlet positioned near the inlet end of the combustion furnace for providing an oxidant, a fuel inlet positioned near the inlet end of the combustion furnace for providing a fuel, a matrix means consisting of metallic spheres for passively mixing the oxidant and the fuel located downstream of the oxidant and fuel inlets, wherein the outermost edges of the matrix means are free from contact with the furnace walls and the baffle plate.

2. The steam generating boiler of claim 1 further comprising a second oxidant inlet located downstream of the matrix means and a second matrix means consisting of metallic spheres located downstream of the second oxidant inlet.

3. The steam generating boiler of claim 2, wherein the second oxidant inlet comprises a plurality of tubes extends horizontally along the width of the second matrix means and each of the plurality of tubes comprises multiple openings for dispersing oxidant.

4. The steam generating boiler of claim 3 further comprising a perforated plate consisting of a plurality of circular holes located upstream of the fuel inlet.

5. The steam generating boiler of claim 4 wherein the fuel inlet consists of a fuel tube extending horizontally along the width of the matrix means and comprises a plurality of holes for dispersing fuel.

6. The steam generating boiler of claim 5 wherein the plurality of holes for dispersing fuel are located in more than one axis.

7. The steam generation of claim 6 further comprising a plurality of cooing tubes located between the matrix means and the second oxidant inlet.

8. A steam generating boiler comprising, a combustion furnace having an inlet end, an outlet end, and further defined by a baffle wall and a plurality of furnace walls, wherein each of the furnace walls comprises a plurality of steam tubes aligned with the vertical length of the furnace wall and in fluid connection with a steam drum located on the opposite side of the baffle wall and downstream of the outlet end of the combustion furnace, a first oxidant inlet positioned near the inlet end of the combustion furnace for providing a first oxidant, a fuel inlet positioned near the inlet end of the combustion furnace for providing a fuel, a perforated plate consisting of a plurality of circular holes located upstream of the fuel inlet, a plurality of steam tubes attached to a wall of the combustion furnace, wherein the steam tubes are fluidly connected to a steam drum located downstream of the combustion chamber, a first matrix means consisting of fitted tiles having venture holes located downstream of the first oxidant inlet and the fuel inlet, wherein the outermost edges of the matrix means are free from contact with the furnace walls and the baffle plate, a second oxidant inlet for providing a second oxidant located downstream of the first matrix means, a second matrix means consisting of fitted tiles having venture holes located downstream of the second oxidant means.

9. The steam generating boiler of claim 8, further comprising an non-coiled inter-stage cooling tube located between the first matrix means and the second matrix means.

10. The steam generating boiler of claim 9, further comprising an igniter located between the first matrix means and the second matrix means.

* * * * *